United States Patent [19]

Suey

[11] Patent Number: 4,666,404

[45] Date of Patent: May 19, 1987

[54] DOOR FOR SLAB-HEATING FURNACE AND THE LIKE

[76] Inventor: Paul V. Suey, 1043 Black Forest Dr., Pittsburgh, Pa. 15235

[21] Appl. No.: 894,351

[22] Filed: Aug. 7, 1986

Related U.S. Application Data

[63] Continuation-in-part of Ser. No. 760,300, Jul. 29, 1985, abandoned.

[51] Int. Cl.[4] ..... F27D 1/18

[52] U.S. Cl. ..... 432/250; 110/173 R; 110/173 C

[58] Field of Search ..... 110/173 R, 173 C; 432/250; 202/242, 247, 248

[56] References Cited

U.S. PATENT DOCUMENTS

| | | |
|---|---|---|
| 890,252 | 6/1908 | Thompson . |
| 2,977,106 | 3/1961 | Duff . |
| 3,580,322 | 5/1971 | Herbert . |
| 3,606,288 | 9/1971 | Bloom . |

FOREIGN PATENT DOCUMENTS

| | | | |
|---|---|---|---|
| 339267 | 12/1919 | Fed. Rep. of Germany | 110/173 C |
| 109755 | 9/1917 | United Kingdom | 110/173 R |
| 332339 | 7/1930 | United Kingdom | 110/173 C |

*Primary Examiner*—Edward G. Favors

*Attorney, Agent, or Firm*—Walter Jr. Blenko, Jr.

[57] ABSTRACT

The specification discloses a door for a slab-heating furnace. A series of closure members are positioned in side-by-side relationship from one side of the opening to the other. Each closure member has one or more sections pivotally connected to an adjacent section.

9 Claims, 7 Drawing Figures

DOOR FOR SLAB-HEATING FURNACE AND THE LIKE

This application is a continuation-in-part of application Ser. No. 760,300 filed July 29, 1985, abandoned.

This invention relates to doors for slab-heating furnaces and the like. More particularly, it relates to doors which are closed by gravity and are opened by movement of slabs into and out of the furnace.

In the rolling of steel, it is often necessary to heat slabs, billets, bars and the like prior to hot rolling. Such heating may be required to raise the metal to a temperature suitable for hot rolling, or the heating may be needed to bring the metal to an even temperature throughout. Substantial heat is required for operation of such furnaces, and such furnaces represent a substantial expense and account for considerable heat loss in a mill. In order to conserve heat and to reduce operating expense, it is desirable to close the entrance and exit openings with a door which will restrict loss of heat except when a slab and the like is entering or leaving the furnace.

I provide door means for a slab-heating furnace which substantially close the opening of the furnace in which the door is positioned. By "slab", I refer to metal, such as steel, which is in semi-finished form and may be called a "slab", "ingot", "billet" or other such term. I provide door comprising a plurality of closure members extending substantially from top to bottom of the furnace opening. I provide a plurality of closure sections hingedly connected to the top of the furnace opening. I further preferably provide a plurality of closures disposed in side-by-side relationship with each closure in juxtaposition to an adjacent closure without being connected thereto.

I prefer to provide a door supporting frame which will hold all of the closure member in juxtaposition to one another. I prefer to provide hinge means comprising a plurality of alternating tongues on adjacent sections of a closure and pivot pin means having a horizontal axis extending through said tongues.

Alternatively, I prefer to provide a door which is comprised of a plurality of door closure assemblies each having a door anchor and a plurality of closures which are arranged in side-by-side relation. Each closure comprises a plurality of vertically arranged sections which are supported by hinge means. The hinge means includes pivot pin means which are generally horizontal and project through each section to an adjacent portion of the closure assembly.

Other details, objects, and advantages of my invention will become more apparent as the following description of a present preferred embodiment thereof proceeds.

In the accompanying drawings, I have illustrated a present preferred embodiment of my invention in which FIG. 1 is an elevational view of the opening of a slab-heating furnace showing a door support frame and several closures in position in the opening and with other closures omitted from the drawings for clarity of illustration;

Figure 1:
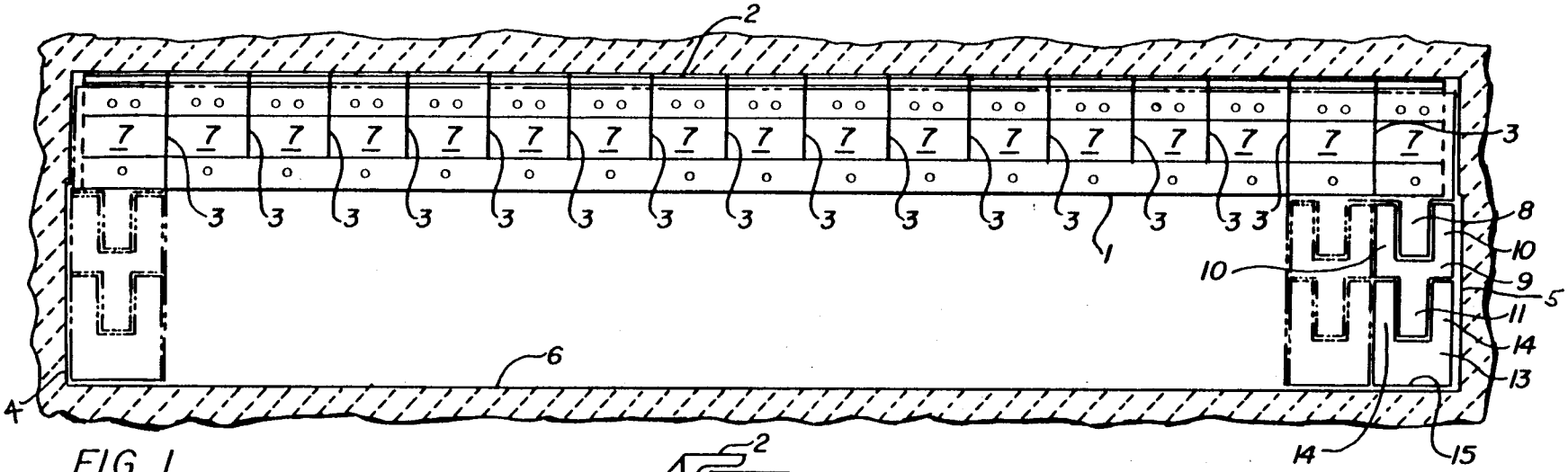

FIGS. 1–4 show a door assembly which is supported from a metal frame comprising a horizontally extending lower channel 1 and a horizontally extending upper channel 2. The upper and lower channels are connected and braced at intervals by gussets 3. The metal frame may be connected in any convenient way to the framework of the furnace, and the frame may serve as a part of the furnace framework. The metal frame is positioned at the top of an opening in the furnace having sides 4 and 5. The bottom of the opening is defined by the furnace hearth 6. A series of anchor blocks 7 are fastened to channels 1 and 2. The anchor blocks are placed side-by-side abutting one another, and as a group, they extend from one side of the furnace opening to the other across the top of the opening. Each anchor block has a depending centrally located tongue 8.

Figure 2:
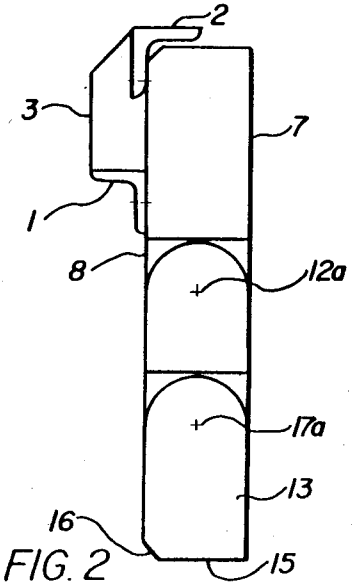
FIG. 2 is an end elevational view of the door assembly shown in FIG. 1.

A closure section 9 is supported beneath anchor block 7. Section 9 is generally rectangular. It has two upwardly extending tongues 10 which are positioned on opposite sides of tongue 8. A pivot pin 12 (FIG. 3) extends through tongues 8 and 10 on axis 12*a* (FIG. 2) and permits pivotal movement of section 9 relative to anchor block 7. A second closure section 13 has two upwardly projecting tongues 14 which are positioned on opposite sides of tongue 11. The lower surface 15 of section 13 clears hearth 6 by a small distance when the closure is hanging free as shown in FIGS. 1 and 2. A bevel 16 is formed on one lower corner of closure section 13. Closure sections 9 and 13 are pivotally connected together by pivot pin 17 on axis 17*a*.

Normally, the furnace door is in the position shown in FIGS. 1 and 2. In each closure, sections 9 and 13 hang down from anchor block 7 to the furnace hearth. Also, the closures extend across the entire width of the opening thereby closing the opening to escape of heat from the furnace and to entry of cold air into the furnace. Anchor blocks 7 and closure sections 9 and 13 are made of a heat-insulating ceramic material which will resist the furnace temperatures.

Figure 3:
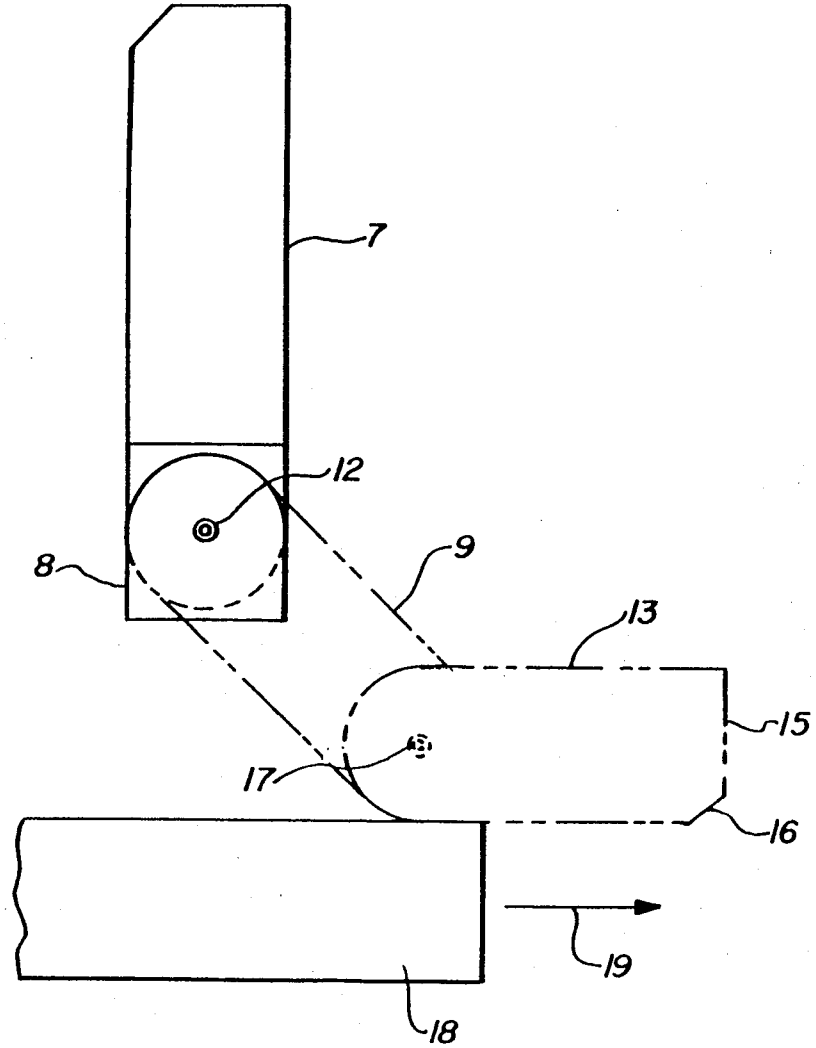
FIG. 3 is a view of the structure shown in FIG. 2 with the closure in open position.

When a slab is pushed through the furnace opening, its leading edge will contact section 13 or both section 13 and section 9. FIG. 3 shows a slab 18 being pushed into the furnace in the direction indicated by arrow 19. Section 9 has been rotated about the axis of pivot pin 12 and section 13 has rotated about the axis of pivot pin 17. Bevel 16 permits section 13 to rotate on the axis of pivot pin 17 without scraping on the hearth. As slab 18 passes through the furnace opening, section 13 is flat on top of slab 18 and section 9 has assumed an angle from the vertical sufficient for clearance of slab 18. In that manner, the space between the hearth and the top of the furnace opening continues to be closed by the slab and the closure sections. The only closure sections which are moved to the position shown in FIG. 3 are those which span the width of the slab. The closure sections to each side of the slab continue to hang in a vertical direction.

It will be apparent that the furnace door construction permits slabs to enter or leave the furnace without power driven opening and closing equipment. At the same time, the construction leaves substantially all the area to each side of the slab closed. The door construction will automatically adapt to and accommodate slabs of different widths and heights. When a slab is entering or leaving the furnace, there is no open space above the slab for heat loss.

Figure 4:
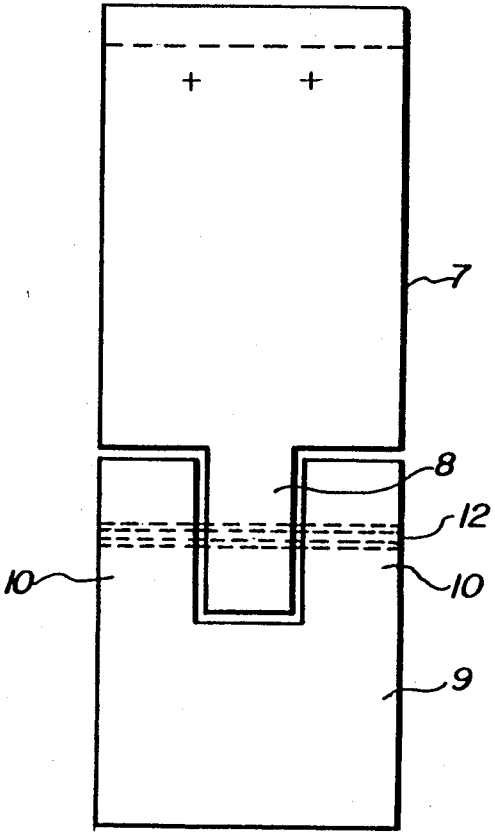
FIG. 4 is an enlarged view of one closure section having a single pivoted panel.

In the embodiment of FIG. 4, only a single hinged section 9 is provided below the anchor block. The door which is constructed in that fashion is suited for installations where only a slab of moderate thickness will be charged to the furnace.

Figure 5:
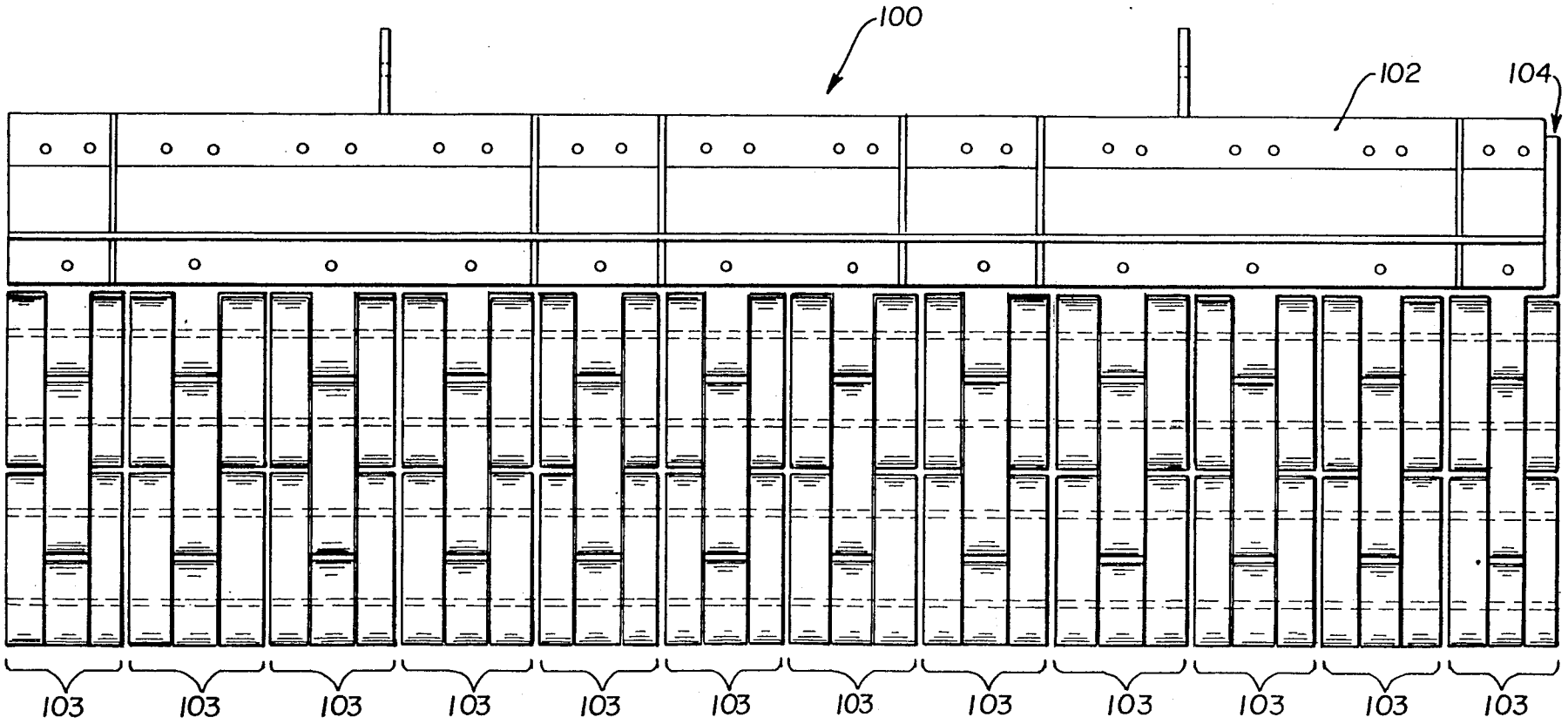
FIG. 5 is a front elevational view of another embodiment of my furnace door.
Figure 7:
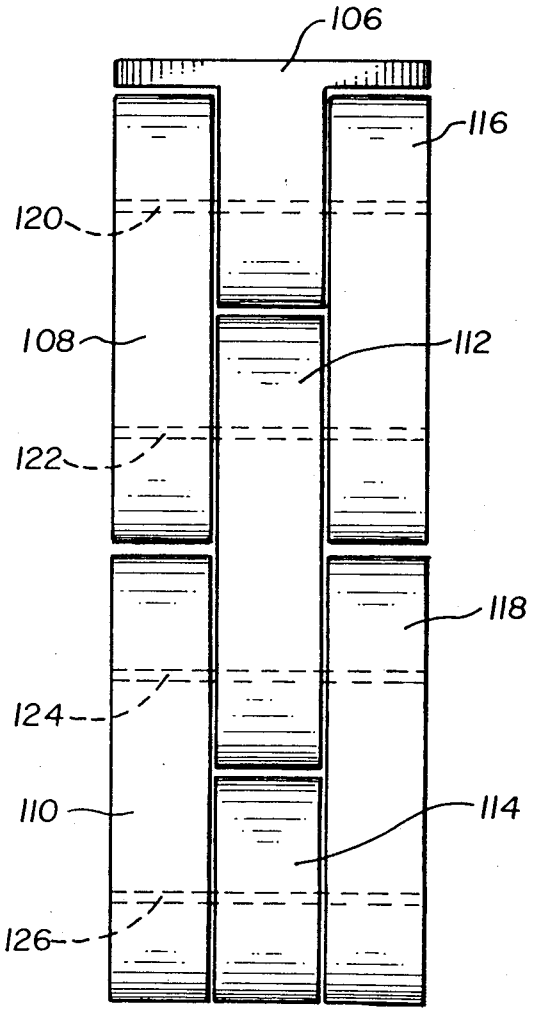
FIG. 7 is a front elevational view of one closure assembly of the furnace door embodied in FIG. 5.
Figure 6:
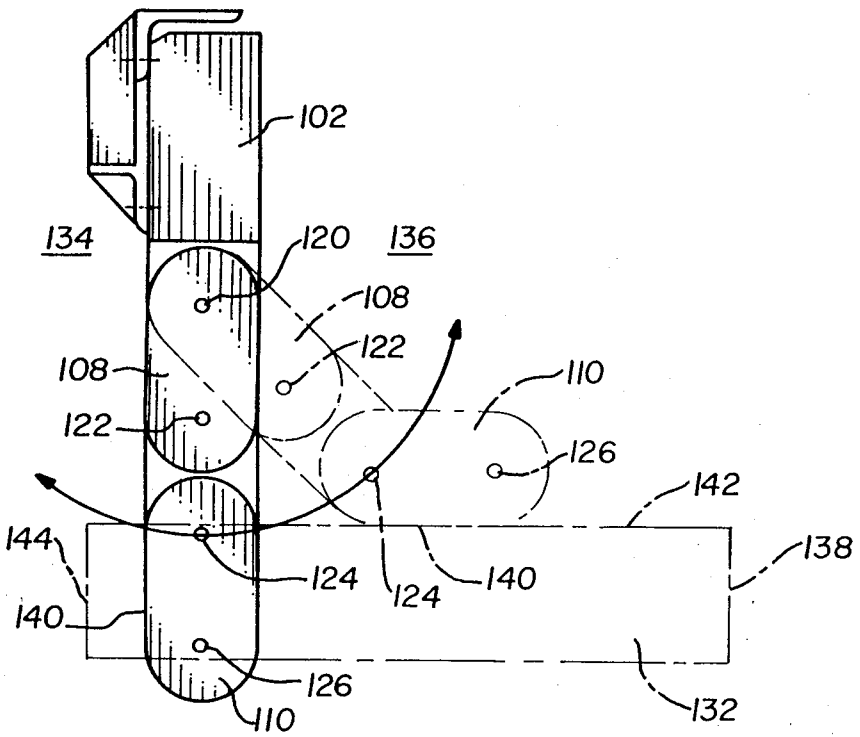
FIG. 6 is a side elevational view of the furnace door embodiment of FIG. 5 showing a portion of the door in both an opened and closed position.

FIGS. 5–7 depict another embodiment of my furnace door. Furnace front 100 includes furnace structure 102 and furnace door 104 which comprises a plurality of closure assemblies 103.

A single closure assembly 103, as shown in FIG. 7, includes anchor block 106 which has a depending centrally located tongue 107. Three closures are supported from anchor block 106. As shown in FIG. 7, the closure to the left of tongue 107 comprises sections 108 and 110. The closure to the right of tongue 107 comprises sections 116 and 118. Directly below tongue 107 is a third closure which comprises sections 112 and 114. Pivot pin 120 hingedly connects sections 108 and 116 to tongue 107. Pivot pin 122 hingedly connects sections 108, 112 and 116. Pivot pin 124 hingedly connects sections 110, 112 and 118. Pivot pin 126 hingedly connects sections 110, 114 and 118. The assembly of sections, along with tongue 107 substantially closes the opening of the furnace.

While six sections and four hinges have been shown and described, it is to be understood that any number of sections and hinges may be incorporated in a particular design depending upon the circumstances. Also, closure assembly 103 may comprise more or less than three closures depending upon specific needs.

FIG. 6 shows the operation of one particular closure under the influence of slab 132 which is moving from the outside 134 of the furnace to interior 136. As slab 132 proceeds from outside 134 to interior 136, leading edge 138 engages surface 140 of section 110. That causes section 108 to pivot rowards interior 136 on hinge 120 and section 110 to pivot towards interior 136 on hinge 124. Surface 140 rides on top 142 of slab 132. When trailing edge 144 of slab 132 fully clears section 110, gravity causes sections 108 and 112 to pivot back to their original generally vertical positions. It may be appreciated that when slab 132 is proceeding from outside 134 to interior 136, the contact between face 140 and top surface 142 substantially prevents heat from escaping from interior 136 to exterior 134.

It is to be understood that each closure assembly 103 hangs independently from each adjacent closure assembly. That is because any particular pivot pin projects only from the left edge of its associated closure assembly to the right edge of the same closure assembly. No pivot pin projects between adjacent closure assemblies. Therefore, should a slab, of a width less than the width of furnace front 100, engage one or more closure assemblies, only those closure assemblies so engaged pivot open while the remaining closure assemblies would stay closed. That feature minimizes the amount of heat loss from the furnace when a slab is entering the furnace interior.

The sections of the door are formed of a refractory material which will withstand furnace temperatures and mechanical stresses resulting from passage of slabs through the furnace opening. One door may be positioned at the slab entrance and another at the slab exit. The doors may be sheathed with stainless steel on one or both sides to protect the refractory material from direct contact with slabs entering and exiting the furnace.

While I have illustrated and described certain present preferred embodiments of my invention, it is to be understood that I do not limit myself thereto and that my invention may be otherwise variously practiced within the scope of the following claims.

I claim:

1. A door for a generally unobstructed opening of a slab heating furnace and the like comprising a plurality of independently hanging closures extending substantially between the top and bottom of the opening and positioned in side-by-side relationship extending from one side of the unobstructed opening to the other side of the unobstructed opening, each of said closures having a plurality of sections, and having hinge means connecting the upper edge of at least one section to the lower edge of a section above it, whereby a slab entering the furnace will contact at least one closure thereby opening only said closures so contacted.

2. A door for an opening of a slab heating furnace and the like comprising a plurality of closures extending substantially between the top and bottom of the opening and positioned in side by side relationship extending from one side of the opening to the other side of the opening, each of said closures having a plurality of sections, first hinge means connecting the upper edge of a second section to the lower edge of a first section above it, and second hinge means connecting the upper edge of a third section to the lower edge of the second section.

3. A door as set forth in claim 2 in which the sections are in tongue and groove relationship to other sections above and below.

4. A door as set forth in claim 2 in which at least some of the sections are sheathed with stainless steel.

5. A door for the opening of a slab heating furnace and the like comprising door anchor means, and a plurality of closures supported therefrom, each closure extending substantially between the top and bottom of the opening and positioned in side-by-side relationship with at least one other closure, each of said closures comprising a plurality of vertically positioned sections, each section supported by hinge means which project generally horizontally through said section and through at least one adjacent portion of said door.

6. A door as set forth in claim 5 with the sections of one closure being vertically offset from the sections in an adjacent closure.

7. A door as set forth in claim 6 with each section being connected to a section in an adjacent closure by at least one generally horizontally extending hinge means.

8. A door as set forth in claim 6 which comprises three said closures.

9. A door as set forth in claim 6 in which said closures are positioned in side-by-side relationship with each other.

* * * * *